US011014354B2

(12) United States Patent
Kinoshita

(10) Patent No.: US 11,014,354 B2
(45) Date of Patent: May 25, 2021

(54) LIQUID EJECTING HEAD AND LIQUID EJECTING APPARATUS

(71) Applicant: SEIKO EPSON CORPORATION, Tokyo (JP)

(72) Inventor: Ryota Kinoshita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/808,901

(22) Filed: Mar. 4, 2020

(65) Prior Publication Data

US 2020/0282723 A1 Sep. 10, 2020

(30) Foreign Application Priority Data

Mar. 7, 2019 (JP) ..... JP2019-041443

(51) Int. Cl.
*B41J 2/135* (2006.01)
*B41J 2/175* (2006.01)
*B41J 2/14* (2006.01)

(52) U.S. Cl.
CPC ..... *B41J 2/135* (2013.01); *B41J 2/17596* (2013.01); *B41J 2002/14419* (2013.01); *B41J 2202/19* (2013.01)

(58) Field of Classification Search
CPC ..... B41J 2/135; B41J 2/17596; B41J 2002/14419; B41J 2202/19
USPC ..... 347/20, 54, 68, 84, 85
See application file for complete search history.

(56) References Cited

U.S. PATENT DOCUMENTS

| | | | | |
|---|---|---|---|---|
| 8,152,285 | B2 * | 4/2012 | Kim | B41J 2/175 347/84 |
| 9,884,483 | B2 * | 2/2018 | Ito | B41J 2/14201 |
| 9,895,884 | B2 * | 2/2018 | Miyajima | B41J 2/1707 |
| 10,449,766 | B2 * | 10/2019 | Hanagami | B41J 2/1634 |
| 2015/0258786 | A1 | 9/2015 | Akahane et al. | |

FOREIGN PATENT DOCUMENTS

| | | |
|---|---|---|
| JP | 2011-194575 | 10/2011 |
| JP | 2015-174392 | 10/2015 |
| JP | 2016-141071 | 8/2016 |

* cited by examiner

*Primary Examiner* — An H Do
(74) *Attorney, Agent, or Firm* — Workman Nydegger

(57) ABSTRACT

A liquid ejecting head including: a first liquid ejecting portion including a first liquid storage chamber storing a liquid and a first nozzle; a second liquid ejecting portion including a second liquid storage chamber storing the liquid and a second nozzle; and a flow path structure being formed by stacking substrates and including a distribution flow path that supplies the liquid to the first liquid storage chamber and the second liquid storage chamber. The distribution flow path includes a common flow path through which the liquid flows, a supply flow path that supplies the liquid to the common flow path, a collection flow path that collects the liquid from the common flow path, a first communication flow path communicating the common flow path with the first liquid storage chamber, and a second communication flow path communicating the common flow path with the second liquid storage chamber.

12 Claims, 11 Drawing Sheets

LIQUID EJECTING HEAD AND LIQUID EJECTING APPARATUS

The present application is based on, and claims priority from JP Application Serial Number 2019-041443, filed Mar. 7, 2019, the disclosure of which is hereby incorporated by reference herein in its entirety.

BACKGROUND

1. Technical Field

The present disclosure relates to a liquid ejecting head and a liquid ejecting apparatus.

2. Related Art

To date, there has been proposed a liquid ejecting apparatus having a configuration in which a liquid such as ink supplied from a liquid container is distributed to a plurality of liquid ejecting portions. For example, in JP-A-2015-174392, there is disclosed a liquid ejecting head including a plurality of ejecting head portions that eject a liquid from a plurality of nozzles and a liquid distributing portion that distributes the liquid supplied from a liquid container to the plurality of ejecting head portions.

In the configuration of JP-A-2015-174392, components contained in the liquid may settle in flow paths that distribute the liquid to a plurality of systems. For example, in a configuration where ink in which a pigment is dispersed is ejected, the pigment may settle in the flow paths that distribute the liquid. As described above, in a state where liquid components settle, there is a possibility that a liquid having desired characteristics cannot be ejected.

SUMMARY

According to an aspect of the present disclosure, a liquid ejecting head includes a first liquid ejecting portion including a first liquid storage chamber that stores a liquid and a first nozzle that ejects the liquid in the first liquid storage chamber, a second liquid ejecting portion including a second liquid storage chamber that stores the liquid and a second nozzle that ejects the liquid in the second liquid storage chamber, and a flow path structure which is formed by stacking a plurality of substrates and in which a distribution flow path that supplies the liquid to the first liquid storage chamber and the second liquid storage chamber is formed, in which the distribution flow path includes a common flow path through which the liquid flows, a supply flow path that supplies the liquid to the common flow path, a collection flow path that collects the liquid from the common flow path, a first communication flow path that couples the common flow path and the first liquid storage chamber with each other, and a second communication flow path that couples the common flow path and the second liquid storage chamber with each other.

According to another aspect of the present disclosure, a liquid ejecting head includes a first liquid ejecting portion including a first liquid storage chamber that stores a liquid and a first nozzle that ejects the liquid in the first liquid storage chamber, a second liquid ejecting portion including a second liquid storage chamber that stores the liquid and a second nozzle that ejects the liquid in the second liquid storage chamber, a third liquid ejecting portion including a third liquid storage chamber that stores a liquid and a third nozzle that ejects the liquid in the third liquid storage chamber, a fourth liquid ejecting portion including a fourth liquid storage chamber that stores the liquid and a fourth nozzle that ejects the liquid in the fourth liquid storage chamber, and a flow path structure which is formed by stacking a plurality of substrates and in which a first distribution flow path that supplies the liquid to the first liquid storage chamber and the second liquid storage chamber, and a second distribution flow path that supplies the liquid to the third liquid storage chamber and the fourth liquid storage chamber are formed, in which the first distribution flow path includes a first common flow path through which the liquid flows, a first supply flow path that supplies the liquid to the first common flow path, a first collection flow path that collects the liquid from the first common flow path, a first communication flow path that couples the first common flow path and the first liquid storage chamber with each other, and a second communication flow path that couples the first common flow path and the second liquid storage chamber with each other, and the second distribution flow path includes a second common flow path through which the liquid flows, a second supply flow path that supplies the liquid to the second common flow path, a second collection flow path that collects the liquid from the second common flow path, a third communication flow path that couples the second common flow path and the third liquid storage chamber with each other, and a fourth communication flow path that couples the second common flow path and the fourth liquid storage chamber with each other.

According to yet another aspect of the present disclosure, a liquid ejecting apparatus includes a liquid ejecting head that ejects a liquid, and a circulation mechanism, in which the liquid ejecting head includes a first liquid ejecting portion including a first liquid storage chamber that stores the liquid and a first nozzle that ejects the liquid in the first liquid storage chamber, a second liquid ejecting portion including a second liquid storage chamber that stores the liquid and a second nozzle that ejects the liquid in the second liquid storage chamber, and a flow path structure which is formed by stacking a plurality of substrates and in which a distribution flow path that supplies the liquid to the first liquid storage chamber and the second liquid storage chamber is formed, the distribution flow path includes a common flow path through which the liquid flows, a supply flow path that supplies the liquid to the common flow path, a collection flow path that collects the liquid from the common flow path, a first communication flow path that couples the common flow path and the first liquid storage chamber with each other, and a second communication flow path that couples the common flow path and the second liquid storage chamber with each other, and the circulation mechanism circulates the liquid collected through the collection flow path to the distribution flow path.

According to yet another aspect of the present disclosure, a liquid ejecting apparatus includes a liquid ejecting head that ejects a liquid onto a medium, and a transport mechanism that transports the medium, in which the liquid ejecting head includes a first liquid ejecting portion including a first liquid storage chamber that stores the liquid and a first nozzle that ejects the liquid in the first liquid storage chamber, a second liquid ejecting portion including a second liquid storage chamber that stores the liquid and a second nozzle that ejects the liquid in the second liquid storage chamber, and a flow path structure which is formed by stacking a plurality of substrates and in which a distribution flow path that supplies the liquid to the first liquid storage chamber and the second liquid storage chamber is formed, the distribution flow path includes a common flow path through which the liquid flows, a supply flow path that supplies the liquid to the common flow path, a collection flow path that collects the liquid from the common flow path, a first communication flow path that couples the common flow path and the first liquid storage chamber with each other, and a second communication flow path that couples the common flow path and the second liquid storage chamber with each other, and the common flow path extends in a direction intersecting a direction in which the medium is transported.

DESCRIPTION OF EXEMPLARY EMBODIMENTS

1. Embodiment 1

Figure 1:
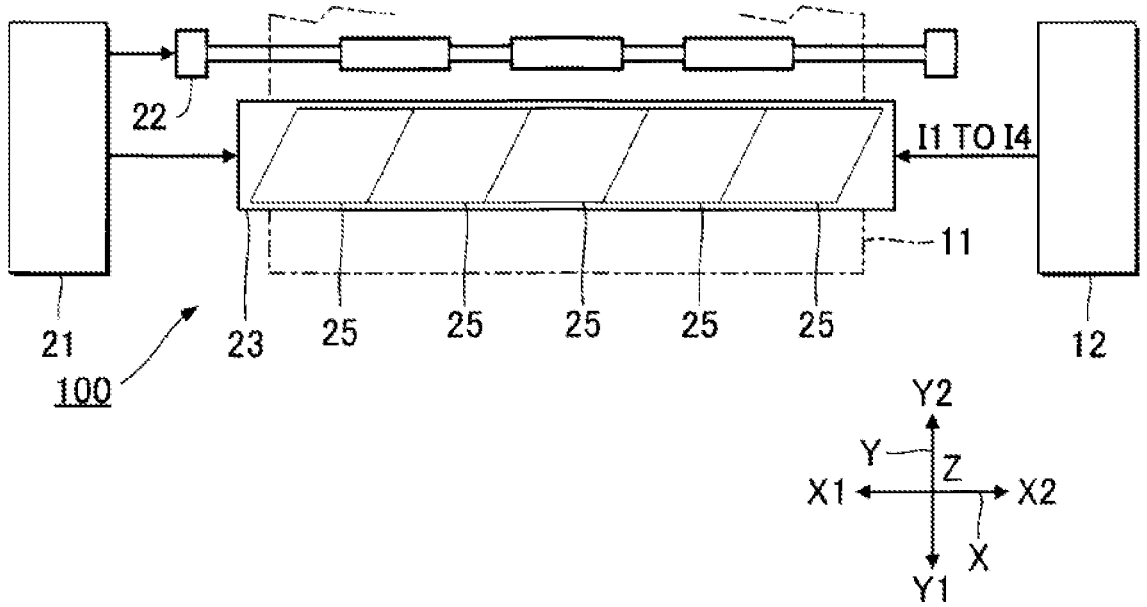
FIG. 1 is a configuration diagram of a liquid ejecting apparatus according to Embodiment 1.

FIG. 1 is a partial configuration diagram of a liquid ejecting apparatus 100 according to Embodiment 1. As illustrated in FIG. 1, the following description assumes an X axis, a Y axis, and a Z axis that are perpendicular to each other. One direction along the X axis when viewed from a certain point is expressed as an X1 direction, and a direction opposite to the X1 direction is expressed as an X2 direction. Similarly, directions opposite to each other along the Y axis when viewed from a certain point are expressed as a Y1 direction and a Y2 direction. An XY plane including the X axis and the Y axis corresponds to a horizontal plane. The Z axis is an axis in the up-down direction. The observation of an object from the direction of the Z axis is hereinafter referred to as "plan view".

The liquid ejecting apparatus 100 according to Embodiment 1 is an ink jet printing apparatus that ejects ink droplets, which are an example of a liquid, onto a medium 11. The medium 11 is, for example, printing paper. However, for example, a printing target of any material such as a resin film or a fabric is used as the medium 11.

As illustrated in FIG. 1, a liquid container 12 is installed in the liquid ejecting apparatus 100. The liquid container 12 stores ink. For example, a cartridge that is configured to be attached to and detached from the liquid ejecting apparatus 100, a bag-like ink pack formed of a flexible film, or an ink tank that can be refilled with ink is used as the liquid container 12. The liquid container 12 of Embodiment 1 stores four types of inks I1 to I4. The four types of inks I1 to I4 are, for example, different in color. For example, the ink I1 is a cyan ink, the ink I2 is a magenta ink, the ink I3 is a yellow ink, and the ink I4 is a black ink. Further, the number of ink types is any number.

As illustrated in FIG. 1, the liquid ejecting apparatus 100 includes a control unit 21, a transport mechanism 22, and a liquid ejecting unit 23. The control unit 21 controls each element of the liquid ejecting apparatus 100. The control unit 21 includes a processing circuit such as a central processing unit (CPU) or a field programmable gate array (FPGA) and a storage circuit such as a semiconductor memory. The control unit 21 functions as a controller that controls the c.

The transport mechanism 22 transports the medium 11 along the Y axis under the control of the control unit 21. The liquid ejecting unit 23 ejects the four types of inks I1 to I4 supplied from the liquid container 12 under the control of the control unit 21. The liquid ejecting unit 23 of Embodiment 1 is a line head that is elongated in the X-axis direction. In parallel with the transport of the medium 11 by the transport mechanism 22, the liquid ejecting unit 23 ejects each of the inks Ik (k=1 to 4) onto the medium 11, thereby forming a desired image on the surface of the medium 11.

Figure 2:
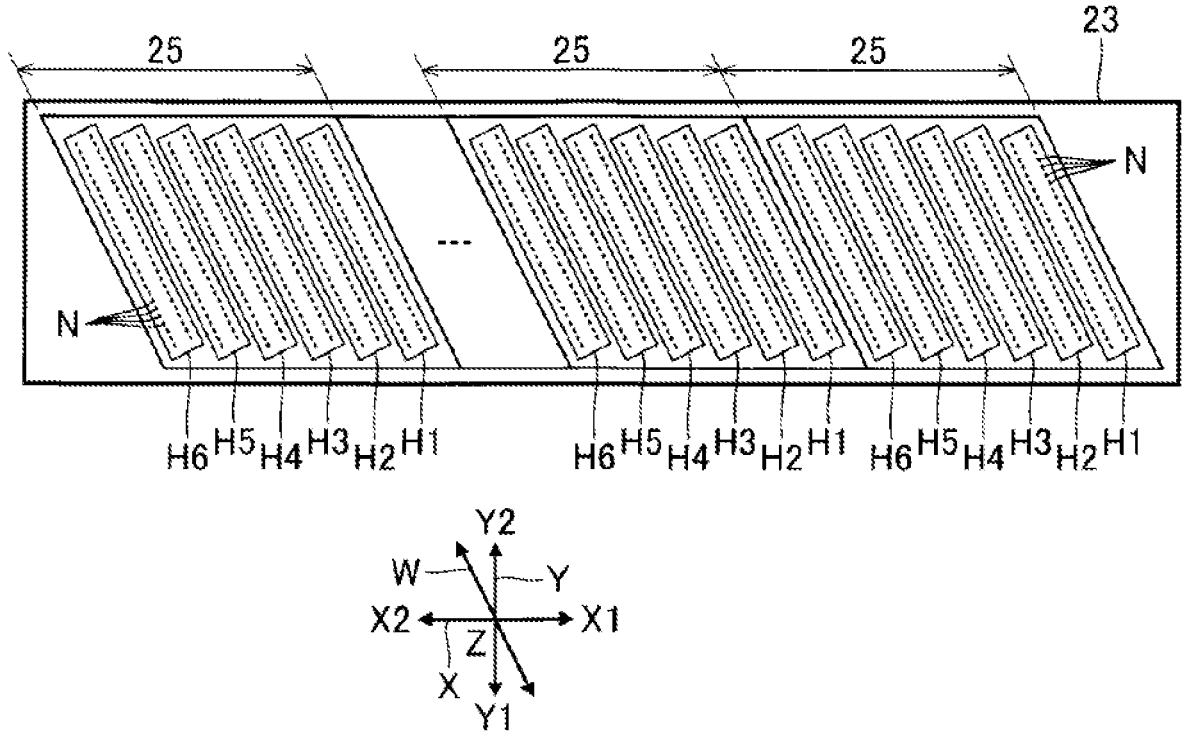
FIG. 2 is a plan view of a surface facing a medium in a liquid ejecting unit.

FIG. 2 is a plan view of a surface of the liquid ejecting unit 23 that faces the medium 11. As illustrated in FIG. 2, the liquid ejecting unit 23 includes a plurality of liquid ejecting heads 25 arranged along the X axis. The number of liquid ejecting heads 25 constituting the liquid ejecting unit 23 is any number. Each of the liquid ejecting heads 25 includes six ejecting head portions H1 to H6 arranged along the X axis. A plurality of nozzles N are formed in each of the ejecting head portions Hm (m=1 to 6). The plurality of nozzles N of the liquid ejecting unit 23 are distributed over the entire range of the medium 11 in the X-axis direction. The four types of inks I1 to I4 stored in the liquid container 12 are supplied in parallel to the six ejecting head portions H1 to H6, and ejected from a plurality of nozzles N of each of the ejecting head portions Hm. Further, the number of the ejecting head portions Hm constituting each of the liquid ejecting heads 25 is any number.

The plurality of nozzles N of the ejecting head portion Hm are arranged along a W axis. The W axis is inclined at a predetermined angle with respect to the X axis or the Y axis in the X-Y plane. For example, the W axis forms an angle of 30° or more and 60° or less with respect to the X axis or the Y axis. As described above, in Embodiment 1, because the plurality of nozzles N are arranged along the W axis that is inclined with respect to the direction of the Y axis along which the medium 11 is transported, compared with a configuration in which a plurality of nozzles N are arranged along the X axis, it is possible to increase the substantial dot density in the X axis direction.

Figure 3:
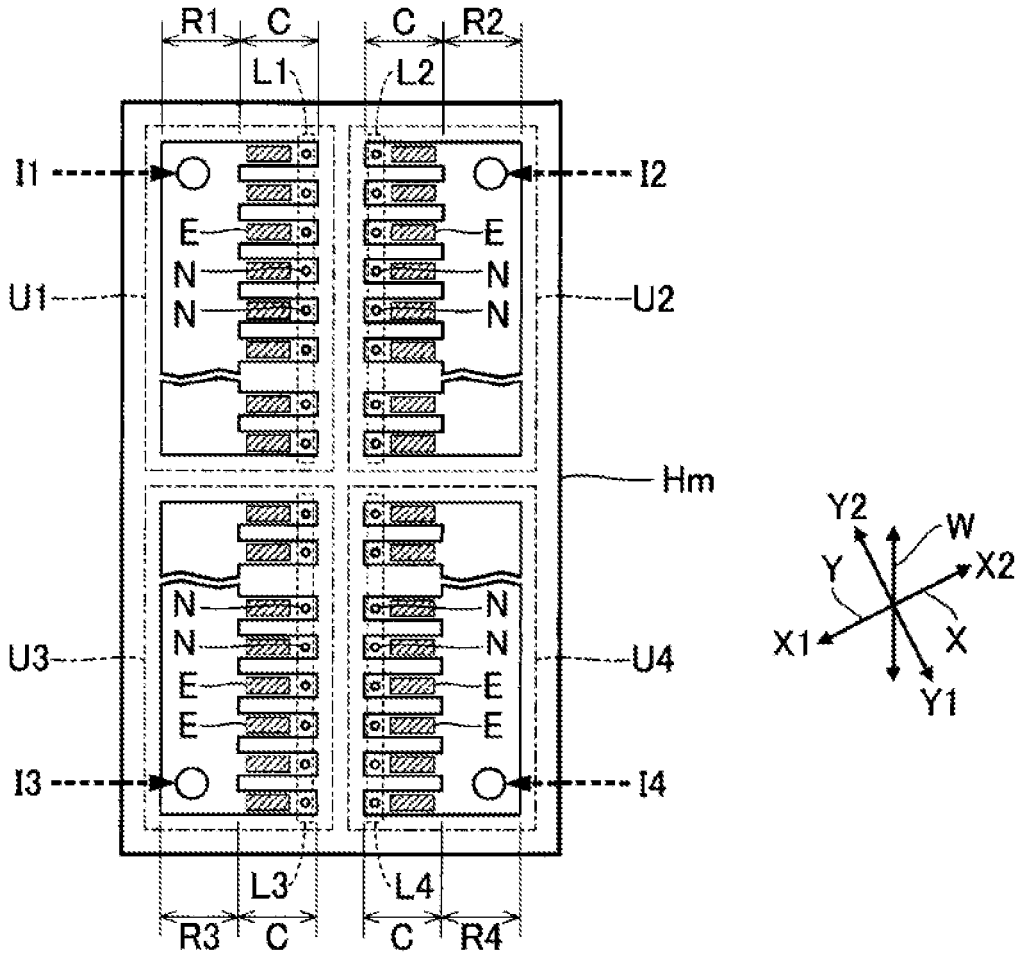
FIG. 3 is a plan view illustrating the configuration of an ejecting head portion.

FIG. 3 is a plan view illustrating the configuration of each of the ejecting head portions Hm. As illustrated in FIG. 3, the plurality of nozzles N of the ejecting head portion Hm are divided into four nozzle rows L1 to L4 corresponding to the respective inks Ik different from each other. Each nozzle row Lk is a set of a plurality of nozzles N disposed along the W axis. The nozzle row L1 and the nozzle row L2 are spaced in a direction perpendicular to the W axis, and the nozzle row L3 and the nozzle row L4 are spaced in a direction perpendicular to the W axis. In addition, the nozzle row L1 and the nozzle row L3 are arranged along the W axis, and the nozzle row L2 and the nozzle row L4 are arranged along the W axis.

As illustrated in FIG. 3, the ejecting head portion Hm includes four liquid ejecting portions U1 to U4 corresponding to the respective nozzle rows Lk different from each other. A liquid storage chamber Rk that stores ink Ik supplied from the liquid container 12 is formed in each of the liquid ejecting portions Uk. The liquid storage chamber Rk is a common liquid chamber that is continuous over a plurality of nozzles N of the nozzle row Lk. The liquid ejecting portion Uk ejects the ink Ik stored in the liquid storage chamber Rk from each of the nozzles N of the nozzle row Lk. The liquid storage chamber Rk of each of the ejecting head portions Hm is a long space in the direction of the W axis. According to the above configuration, the ink Ik can be efficiently supplied from the liquid storage chamber Rk to the plurality of nozzles N arranged along the W axis. Further, the direction of the X axis is an example of the "first direction", and the direction of the W axis is an example of the "second direction".

As illustrated in FIG. 3, each of the liquid ejecting portions Uk includes a plurality of pressure chambers C and a plurality of drive elements E. The pressure chamber C and the drive element E are formed for each of the nozzles N. The pressure chamber C is a space communicating with the nozzle N. The plurality of pressure chambers C of the liquid ejecting portion Uk are filled with the ink Ik supplied from the liquid storage chamber Rk. The drive element E varies the pressure of the ink Ik in the pressure chamber C. For example, a piezoelectric element that changes the volume of the pressure chamber C by deforming the wall surface of the pressure chamber C, or a heating element that causes film boiling in the pressure chamber C by heating the ink Ik in the pressure chamber C is preferably used as the drive element E. An electrostatic actuator may be used as the drive element E. The drive element E varies the pressure of the ink Ik in the pressure chamber C so that the ink Ik in the pressure chamber C is ejected from the nozzle N.

Figure 4:
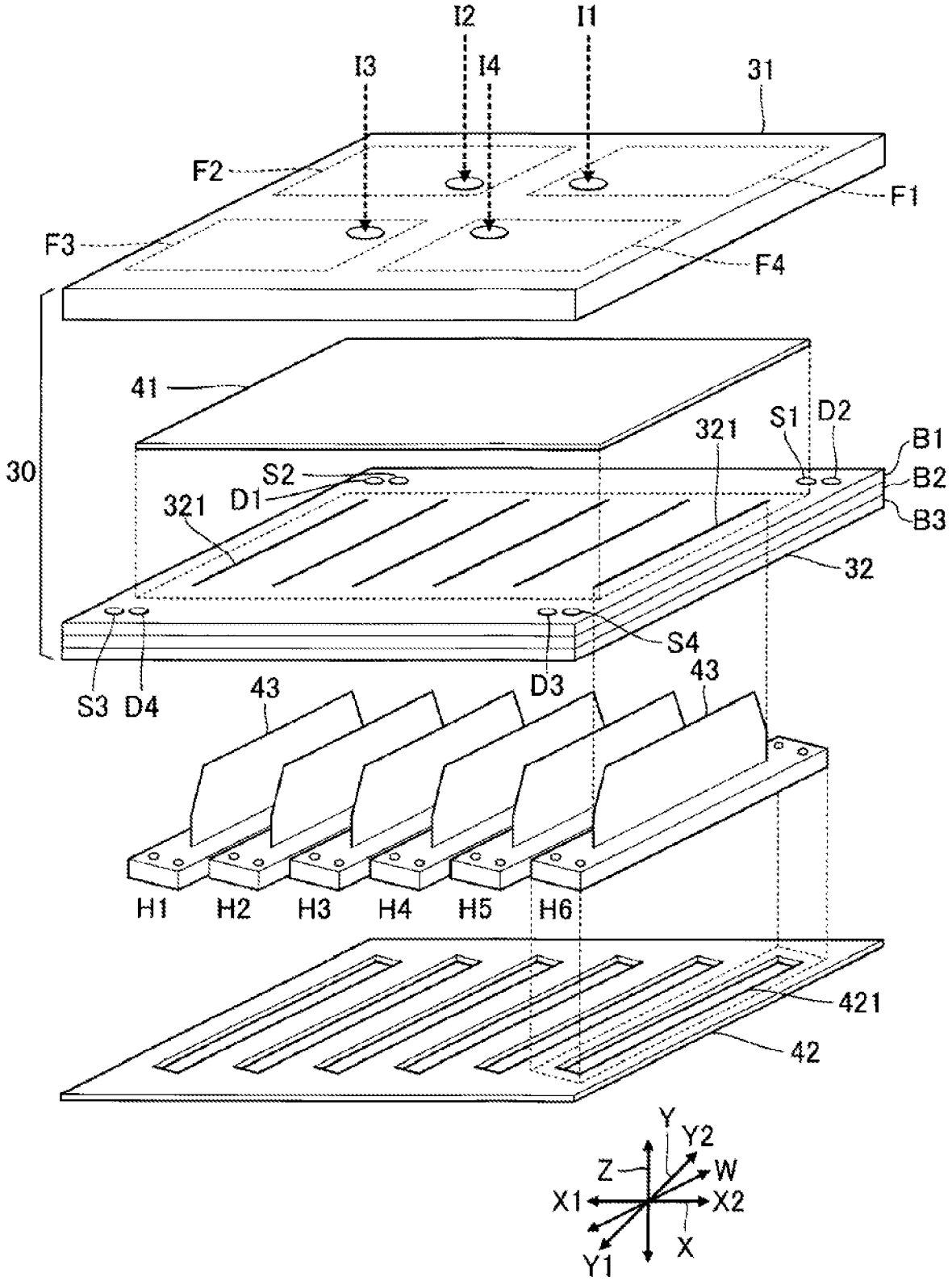
FIG. 4 is an exploded perspective view illustrating the configuration of a liquid ejecting head.

FIG. 4 is an exploded perspective view illustrating the configuration of one liquid ejecting head 25. As illustrated in FIG. 4, the liquid ejecting head 25 includes a flow path structure 30, a control substrate 41, the six ejecting head portions H1 to H6, and a support substrate 42. The six ejecting head portions H1 to H6 are installed between the flow path structure 30 and the support substrate.

The support substrate 42 supports the six ejecting head portions H1 to H6. For example, a plate-like member formed of a highly rigid material such as stainless steel is preferably used as the support substrate 42. The support substrate 42 is formed with openings 421 each of which exposes the plurality of nozzles N of corresponding one of the ejecting head portions Hm.

The flow path structure 30 in FIG. 4 is a structure for supplying the four types of inks I1 to I4 stored in the liquid container 12 to each of the six ejecting head portions H1 to H6. The flow path structure 30 according to Embodiment 1 includes a liquid processing portion 31 and a liquid distributing portion 32. The control substrate 41 is installed between the liquid processing portion 31 and the liquid distributing portion 32. The control substrate 41 is a wiring substrate for electrically coupling the control unit 21 and the ejecting head portions Hm to each other.

As illustrated in FIG. 4, a wiring substrate 43 is installed on each of the ejecting head portions Hm. The wiring substrate 43 is a flexible mounting component on which wiring for electrically coupling the ejecting head portion Hm to the control substrate 41 is formed. The wiring substrate 43 of each of the ejecting head portions Hm is inserted into a corresponding insertion hole 321 formed in the liquid distributing portion 32, and the tip of the wiring substrate 43 is joined to the control substrate 41. Each of the drive elements E is driven using a drive signal and a power supply voltage supplied from the control substrate 41 to a corresponding one of the ejecting head portions Hm via a corresponding one of the wiring substrates 43.

Figure 5:
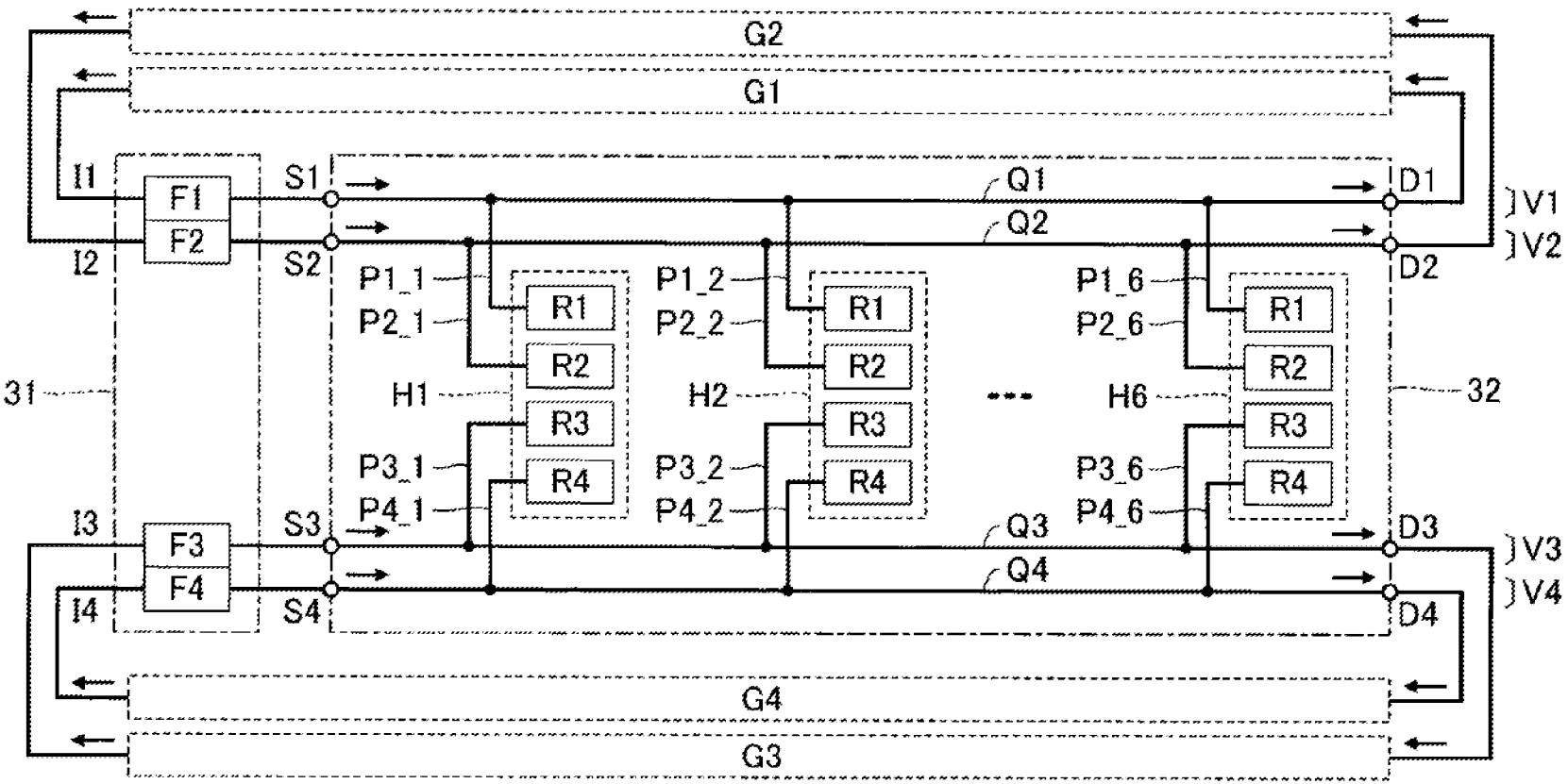
FIG. 5 is an explanatory diagram of an internal flow path of a flow path structure.

FIG. 5 is an explanatory diagram of the internal flow path of the flow path structure 30. As illustrated in FIG. 5, four filters F1 to F4 corresponding to the respective inks Ik different from each other and circulation mechanisms Gk described below are installed inside the liquid processing portion 31. Each of the filters Fk collects bubbles or foreign matter mixed in the ink Ik supplied from the liquid container 12. The liquid distributing portion 32 distributes the ink Ik that has passed through each filter Fk of the liquid processing portion 31 to the six ejecting head portions H1 to H6.

In the liquid distributing portion 32, four distribution flow paths V1 to V4 corresponding to the respective inks Ik different from each other are formed. Each of the distribution flow paths Vk is a flow path for supplying ink Ik to the liquid storage chambers Rk of each of the six ejecting head portions H1 to H6. As illustrated in FIG. 5, each of the distribution flow paths Vk includes a supply flow path Sk, a common flow path Qk, and a collection flow path Dk. That is, as illustrated in FIGS. 4 and 5, four supply flow paths S1 to S4 corresponding to the respective inks Ik different from each other and four collection flow paths D1 to D4 corresponding to the respective inks Ik different from each other are formed in the flow path structure 30.

The supply flow path Sk communicates with the common flow path Qk. The ink Ik that has passed through the filter Fk of the liquid processing portion 31 is supplied to the supply flow path Sk. The supply flow path Sk is a flow path that supplies the ink Ik to the common flow path Qk.

As illustrated in FIG. 5, in each of the common flow paths Qk, six communication flow paths Pk_1 to Pk_6 corresponding to different ones of the ejecting head portions Hm are formed. Each of the communication flow paths Pk_m is a flow path that branches from the common flow path Qk. The liquid storage chamber Rk of each of the ejecting head portions Hm communicates with the common flow path Qk via the communication flow path Pk_m. Accordingly, the ink Ik supplied from the supply flow path Sk to the common flow path Qk passes through each of the communication flow paths Pk_m and is supplied to the liquid storage chambers Rk of the ejecting head portions Hm. That is, the ink Ik is supplied in parallel to each of the liquid storage chambers Rk of the six ejecting head portions H1 to H6.

As illustrated in FIG. 5, the collection flow path Dk communicates with the common flow path Qk. The collection flow path Dk is a flow path for collecting the ink Ik from the common flow path Qk. That is, out of the ink Ik supplied from the supply flow path Sk to the common flow path Qk, the ink Ik that is not supplied to any of the six ejecting head portions H1 to H6 is discharged from the common flow path Qk to the collection flow path Dk.

As illustrated in FIG. 5, the liquid ejecting apparatus 100 includes four circulation mechanisms G1 to G4 corresponding to respective inks Ik different from each other. Each of the circulation mechanisms Gk is a mechanism for circulating the ink Ik collected through a corresponding one of the collection flow paths Dk to each of the ejecting head portions Hm. Each of the circulation mechanisms Gk is, for example, installed in the liquid processing portion 31.

Figure 6:
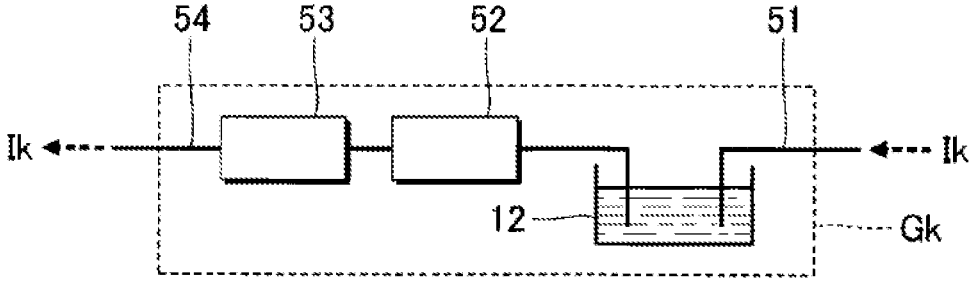
FIG. 6 is a block diagram illustrating a configuration of a circulation mechanism.

FIG. 6 is a block diagram illustrating the configuration of the circulation mechanism Gk. As illustrated in FIG. 6, the circulation mechanism Gk includes a first circulation flow path 51, a circulation pump 52, a heating mechanism 53, and a second circulation flow path 54. The first circulation flow path 51 circulates the ink Ik supplied from the collection flow path Dk to the liquid container 12. The circulation pump 52 is a pressure feeding mechanism that feeds the ink Ik stored in the liquid container 12 at a predetermined pressure. The heating mechanism 53 adjusts the temperature of the ink Ik by heating the ink Ik fed by the circulation pump 52. The second circulation flow path 54 supplies the ink Ik heated by the heating mechanism 53 to the flow path structure 30.

The ink Ik fed from the circulation mechanism Gk passes through the filter Fk of the liquid processing portion 31 and is then supplied to the supply flow path Sk of the liquid distributing portion 32. That is, as understood from FIG. 5, out of the ink Ik supplied to the common flow path Qk of the liquid distributing portion 32, the ink Ik that is not supplied to each of the ejecting head portions Hm is circulated along a route that is the common flow path Qk→the collection flow path Dk→the circulation mechanism Gk→the filter Fk→the supply flow path Sk→the common flow path Qk. The above circulation operation is executed in parallel for each of the four types of inks I1 to I4. In addition, the circulation operation demonstrated above is performed in parallel with an ejecting operation within the period when the ejecting operation is performed. However, the circulation operation may be executed within a period in which the ejecting operation is not executed.

As described above, in Embodiment 1, the filter Fk is installed upstream of the supply flow path Sk. Therefore, there is an advantage that, for each of the six ejecting head portions H1 to H6, the liquid ejecting head 25 can be easily decreased in size as compared with a configuration in which separate filters are installed downstream of the common flow path Qk.

As illustrated in FIG. 4, the liquid distributing portion 32 is formed by stacking a plurality of substrates B (B1 to B3). The plurality of substrates B are formed by, for example, injection molding of a resin material and are bonded to each other with an adhesive. Alternatively, a substrate made of any material such as a single-crystal silicon substrate or a glass substrate may be used as each of the substrates B of the liquid distributing portion 32. The liquid distributing portion 32 of Embodiment 1 is a structure in which a first substrate B1, a second substrate B2, and a third substrate B3 are stacked along the Z axis. The second substrate B2 is located between the first substrate B1 and the third substrate B3. The first substrate B1 is located between the second substrate B2 and the liquid processing portion 31, and the third substrate B3 is located between the second substrate B2 and the six ejecting head portions H1 to H6.

Figure 7:
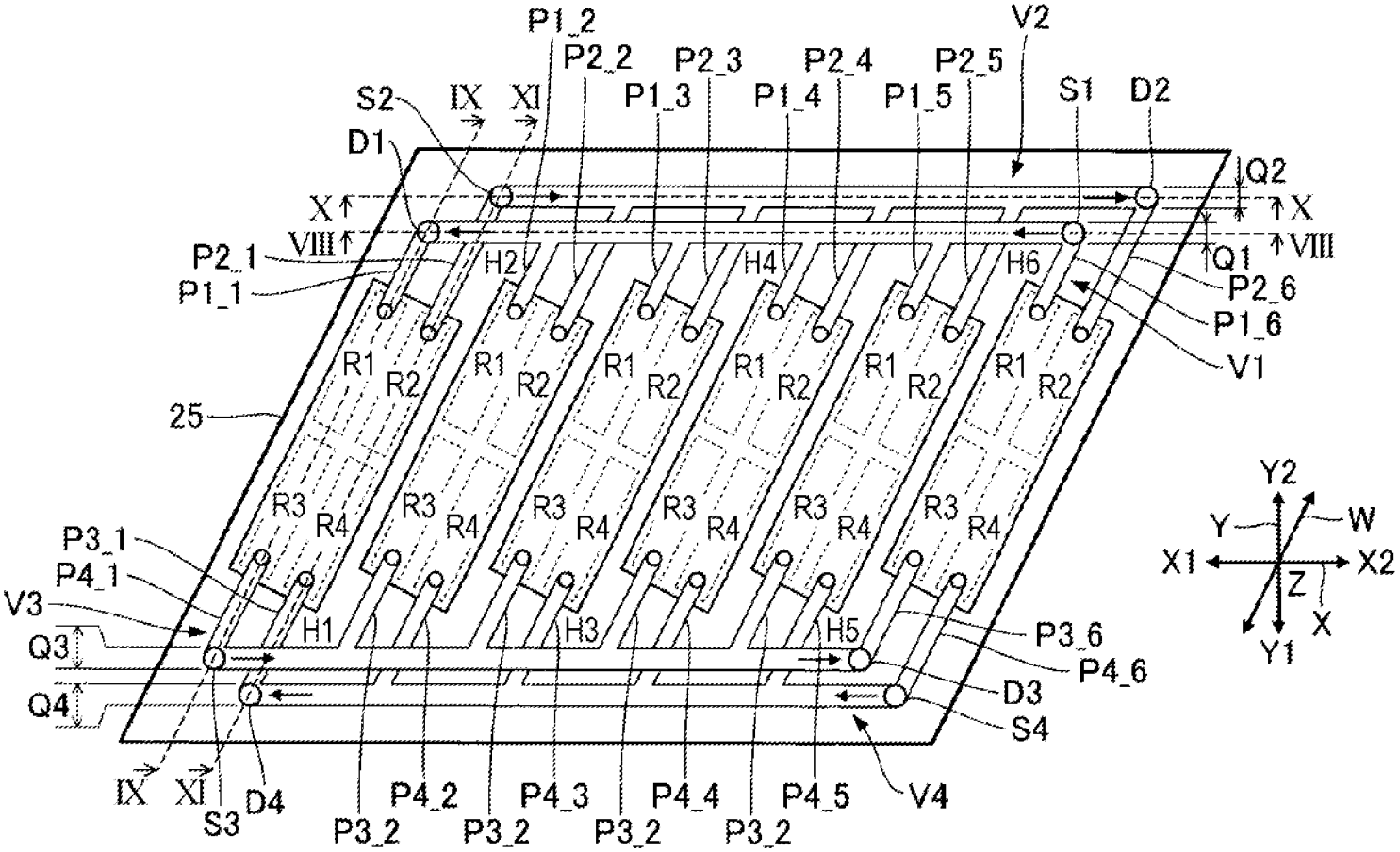
FIG. 7 is a plan view schematically illustrating the configuration of an internal flow path of a liquid distributing portion.

FIG. 7 is a plan view schematically illustrating the configuration of the internal flow path of the liquid distributing portion 32. FIG. 7 also illustrates four liquid storage chambers R1 to R4 in each of the six ejecting head portions H1 to H6. As understood from FIG. 7, the liquid storage chambers Rk in the ejecting head portions H1 to H6 are provided side by side in the X-axis direction.

Figure 8:
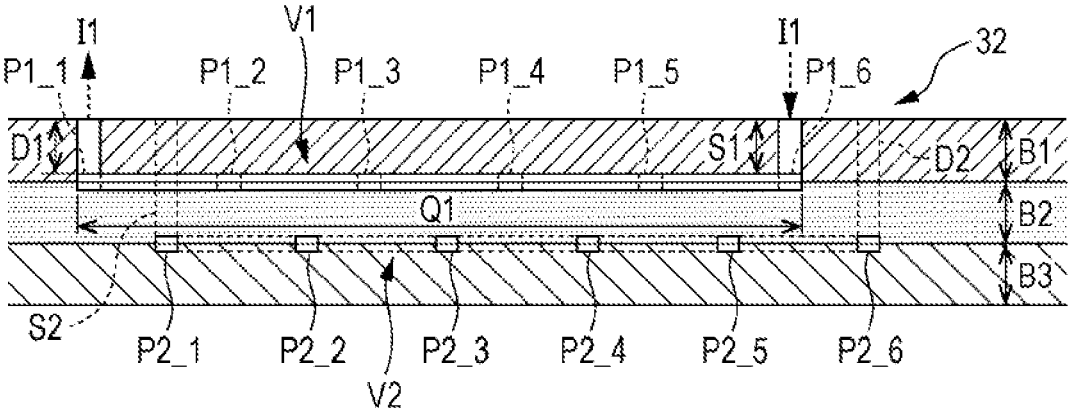
FIG. 8 is a sectional view taken along line VIII-VIII in FIG. 7.
Figure 9:
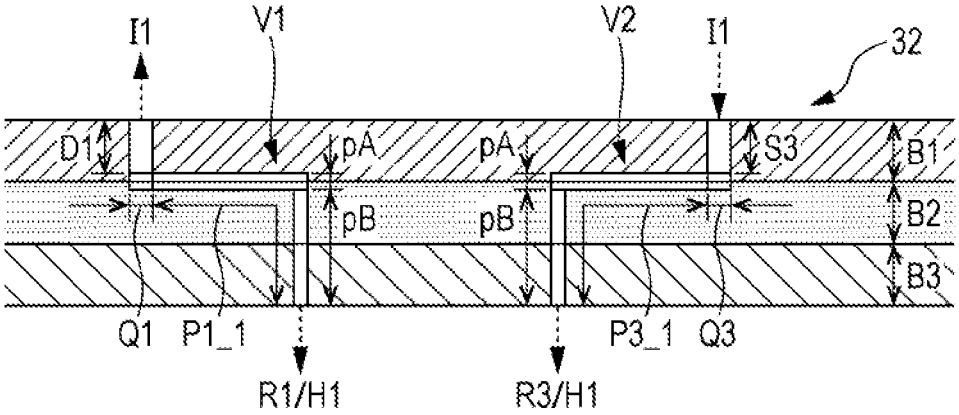
FIG. 9 is a sectional view taken along line IX-IX in FIG. 7.
Figure 10:
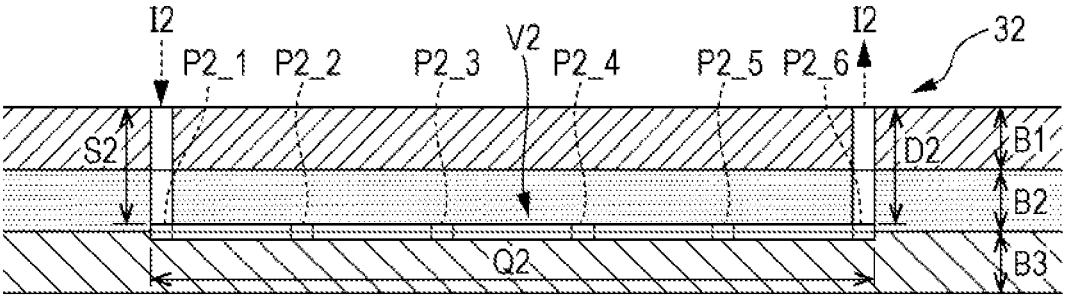
FIG. 10 is a sectional view taken along line X-X in FIG. 7.
Figure 11:
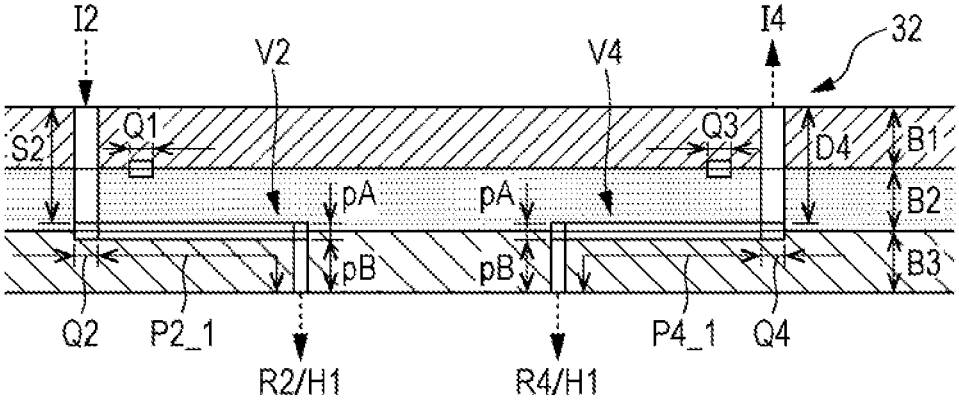
FIG. 11 is a sectional view taken along line XI-XI in FIG. 7.

FIGS. 8 to 11 are sectional views of the liquid distributing portion 32. FIG. 8 is a sectional view taken along line VIII-VIII in FIG. 7. FIG. 9 is a sectional view taken along line IX-IX in FIG. 7. FIG. 10 is a sectional view taken along line X-X in FIG. 7. FIG. 11 is a sectional view taken along line XI-XI in FIG. 7.

As illustrated in FIG. 7, the common flow path Q1 and the common flow path Q3 extend linearly along the X axis. The common flow path Q1 and the common flow path Q3 are formed between the first substrate B1 and the second substrate B2, as illustrated in FIG. 8. Specifically, the common flow path Q1 and the common flow path Q3 are formed by combining a groove formed at the surface of the first substrate B1 facing the second substrate B2, and a groove formed at the surface of the second substrate B2 facing the first substrate B1.

As illustrated in FIGS. 8 and 9, the supply flow path S1, the collection flow path D1, the supply flow path S3, and the collection flow path D3 are through holes that penetrate the first substrate B1 in the thickness direction. The thickness direction of the first substrate B1 is a direction parallel to the Z axis. As illustrated in FIG. 7, the supply flow path S1 communicates with the X2-direction end of the common flow path Q1, and the collection flow path D1 communicates with the X1-direction end of the common flow path Q1. Accordingly, the ink I1 travels in the X1 direction in the common flow path Q1. On the other hand, the supply flow path S3 communicates with the X1-direction end of the common flow path Q3, and the collection flow path D3 communicates with the X2-direction end of the common flow path Q3. Therefore, the ink I3 travels in the X2 direction in the common flow path Q3. That is, the ink I1 in the common flow path Q1 and the ink I3 in the common flow path Q3 flow in opposite directions.

As illustrated in FIG. 9, each of the six communication flow paths P1_1 to P1_6 communicating with the common flow path Q1 includes a branch portion pA and a communication portion pB. The branch portion pA is a portion that branches from the common flow path Q1 in the direction of the W axis, and couples the common flow path Q1 and the communication portion pB to each other. The branch portion pA is formed between the first substrate B1 and the second substrate B2 together with the common flow path Q1. The communication portion pB of the communication flow path P1_*m* communicates with the liquid storage chamber R1 of the ejecting head portion Hm. As illustrated in FIG. 9, the communication portion pB is a through hole that penetrates the second substrate B2 and the third substrate B3 in the thickness direction. As described above with reference to FIG. 5, the ink I1 flowing from the common flow path Q1 into the communication flow paths P1_*m* is supplied to the liquid storage chambers R1 of the ejecting head portions Hm.

As illustrated in FIG. 9, each of the six communication flow paths P3_1 to P3_6 communicating with the common flow path Q3 includes a branch portion pA and a communication portion pB, similarly to the communication flow path P1_*m*. The branch portion pA of each of the communication flow paths P3_*m* is formed between the first substrate B1 and the second substrate B2 together with the common flow path Q3, and the communication portion pB penetrates the second substrate B2 and the third substrate B3 in the thickness direction. The ink I3 flowing from the common flow path Q3 into the communication flow paths P3_m is supplied to the liquid storage chambers R3 of the ejecting head portions Hm.

As illustrated in FIG. 7, the common flow path Q2 and the common flow path Q4 extend linearly along the X axis, similarly to the common flow path Q1 and the common flow path Q3. As illustrated in FIG. 10, the common flow path Q2 and the common flow path Q4 are formed between the second substrate B2 and the third substrate B3. Specifically, the common flow path Q2 and the common flow path Q4 are formed by combining a groove formed at the surface of the second substrate B2 facing the third substrate B3, and a groove formed at the surface of the third substrate B3 facing the second substrate B2.

As illustrated in FIGS. 10 and 11, the supply flow path S2, the collection flow path D2, the supply flow path S4, and the collection flow path D4 are through holes penetrating the first substrate B1 and the second substrate B2 in the thickness direction. As illustrated in FIG. 7, the supply flow path S2 communicates with the X1-direction end of the common flow path Q2, and the collection flow path D2 communicates with the X2-direction end of the common flow path Q2. Accordingly, the ink I2 travels in the X2 direction in the common flow path Q2. That is, the ink I1 in the common flow path Q1 and the ink I2 in the common flow path Q2 flow in opposite directions. On the other hand, the supply flow path S4 communicates with the X2-direction end of the common flow path Q4, and the collection flow path D4 communicates with the X1-direction end of the common flow path Q4. Accordingly, the ink I4 travels in the X1 direction in the common flow path Q4. That is, the ink I3 in the common flow path Q3 and the ink I4 in the common flow path Q4 flow in opposite directions.

As illustrated in FIG. 11, each of the six communication flow paths P2_1 to P2_6 communicating with the common flow path Q2 includes a branch portion pA and a communication portion pB. The branch portion pA is a portion that branches from the common flow path Q2 in the direction of the W axis, and couples the common flow path Q2 and the communication portion pB to each other. The branch portion pA is formed between the second substrate B2 and the third substrate B3 together with the common flow path Q2. The communication portion pB of the communication flow path P2_m communicates with the liquid storage chamber R2 of the ejecting head portion Hm. As illustrated in FIG. 11, the communication portion pB is a through hole that penetrates the third substrate B3 in the thickness direction. As described above with reference to FIG. 5, the ink I1 flowing from the common flow path Q2 into the communication flow paths P2_m is supplied to the liquid storage chambers R2 of the ejecting head portions Hm.

As illustrated in FIG. 11, each of the six communication flow paths P4_1 to P4_6 communicating with the common flow path Q4 includes the branch portion pA and the communication portion pB, similarly to the communication flow path P2_m. The branch portion pA of each of the communication flow paths P4_m is formed between the second substrate B2 and the third substrate B3 together with the common flow path Q4, and the communication portion pB penetrates the third substrate B3 in the thickness direction. The ink I4 flowing from the common flow path Q4 into the communication flow paths P4_m is supplied to the liquid storage chambers R4 of the ejecting head portions Hm.

As understood from FIG. 7, the distribution flow path V1 and the distribution flow path V2 partially overlap in plan view. Similarly, the distribution flow path V3 and the distribution flow path V4 partially overlap in plan view. According to the above configuration, compared with the configuration in which the distribution flow path V1 and the distribution flow path V2 do not overlap in plan view, or the configuration in which the distribution flow path V3 and the distribution flow path V4 do not overlap in plan view, the size of the flow path structure 30 in the XY plane can be reduced.

As understood from the above description, in Embodiment 1, the ink Ik that is not supplied to the liquid storage chambers Rk of the ejecting head portions Hm out of the ink Ik supplied from the supply flow path Sk to the common flow path Qk is collected via the collection flow path Dk. Therefore, the flow of the ink Ik in the common flow path Qk is promoted compared with a configuration in which the collection flow path Dk is not installed. According to the above configuration, it is possible to reduce the possibility that components such as pigments contained in the ink Ik settle in the distribution flow path Vk.

In Embodiment 1, the supply flow path S1 and the collection flow path D1 are formed in the common first substrate B1, and the supply flow path S3 and the collection flow path D3 are similarly formed in the first substrate B1. In addition, the supply flow path S2 and the collection flow path D2 are formed in the second substrate B2 and the third substrate B3, and the supply flow path S4 and the collection flow path D4 are similarly formed in the second substrate B2 and the third substrate B3. That is, the supply flow path Sk and the collection flow path Dk are formed at a common substrate. Therefore, according to Embodiment 1, there is an advantage that the flow path structure 30 can be easily reduced in size as compared with the configuration in which the supply flow path Sk and the collection flow path Dk are formed at separate substrates.

As understood from FIG. 7, in Embodiment 1, the common flow path Qk extends in the direction of the X axis in the configuration in which the liquid storage chambers Rk in the six ejecting head portions H1 to H6 are arranged in parallel in the X-axis direction. Therefore, there is an advantage that the ink Ik can be efficiently supplied to the liquid storage chamber Rk of each of the ejecting head portions Hm.

In the configuration described above, attention is paid to two ejecting head portions Hm1 and Hm2 ($m1 \neq m2$) among the six ejecting head portions H1 to H6 constituting the liquid ejecting head 25. The distribution flow path Vk of the flow path structure 30 is expressed as a flow path that supplies the ink Ik to the liquid ejecting portion Uk of the ejecting head portion Hm1 and the liquid ejecting portion Uk of the ejecting head portion Hm2. The liquid ejecting portion Uk of the ejecting head portion Hm1 is an example of the "first liquid ejecting portion", and the liquid storage chamber Rk of the liquid ejecting portion Uk is an example of the "first liquid storage chamber". Similarly, the liquid ejecting portion Uk of the ejecting head portion Hm2 is an example of the "second liquid ejecting portion", and the liquid storage chamber Rk of the liquid ejecting portion Uk is an example of the "second liquid storage chamber". In addition, the communication flow path Pk_m1 that couples the common flow path Qk and the liquid ejecting portion Uk of the ejecting head portion Hm1 to each other is an example of the "first communication flow path", and the communication flow path Pk_m2 that couples the common flow path Qk and the liquid ejecting portion Uk of the ejecting head portion Hm2 to each other is an example of the "second communication flow path".

Focusing on the common flow path Q1 and the common flow path Q3, the first substrate B1 corresponds to the "first substrate in which a supply flow path and a collection flow path are formed", and the second substrate B2 and the third substrate B3 correspond to the "second substrate in which a first communication flow path and a second communication flow path are formed". Focusing on the common flow path Q2 and the common flow path Q4, the first substrate B1 and the second substrate B2 correspond to the "first substrate in which a supply flow path and a collection flow path are formed", and the third substrate B3 corresponds to the "second substrate in which a first communication flow path and a second communication flow path are formed".

In addition, attention is paid to two distribution flow paths Vk1 and Vk2 among the four distribution flow paths V1 to V4 formed in the flow path structure 30 (k1≠k2). The distribution flow path Vk1 is an example of the "first distribution flow path". The common flow path Qk1 of the distribution flow path Vk1 is an example of the "first common flow path", the supply flow path Sk1 is an example of the "first supply flow path", and the collection flow path Dk1 is an example of the "first collection flow path". The distribution flow path Vk2 is an example of the "second distribution flow path". The common flow path Qk2 of the distribution flow path Vk2 is an example of the "second common flow path", the supply flow path Sk2 is an example of the "second supply flow path", and the collection flow path Dk2 is an example of the "second collection flow path".

Attention is paid to the ejecting head portion Hm1 and the ejecting head portion Hm2 that are the targets of the distribution of the ink Ik1 by the distribution flow path Vk1 and the distribution of the ink Ik2 by the distribution flow path Vk2. The distribution flow path Vk1 distributes the ink Ik1 to the liquid ejecting portion Uk1 of the ejecting head portion Hm1 and the liquid ejecting portion Uk1 of the ejecting head portion Hm2. The liquid ejecting portion Uk1 of the ejecting head portion Hm1 is an example of the "first liquid ejecting portion", and the liquid storage chamber Rk1 of the liquid ejecting portion Uk1 is an example of the "first liquid storage chamber". In addition, the liquid ejecting portion Uk1 of the ejecting head portion Hm2 is an example of the "second liquid ejecting portion", and the liquid storage chamber Rk1 of the liquid storage chamber Uk1 is an example of the "second liquid storage chamber". Similarly, the distribution flow path Vk2 distributes the ink Ik2 to the liquid ejecting portion Uk2 of the ejecting head portion Hm1 and the liquid ejecting portion Uk2 of the ejecting head portion Hm2. The liquid ejecting portion Uk2 of the ejecting head portion Hm1 is an example of the "third liquid ejecting portion", and the liquid storage chamber Rk2 of the liquid ejecting portion Uk2 is an example of the "third liquid storage chamber". In addition, the liquid ejecting portion Uk2 of the ejecting head portion Hm2 is an example of the "fourth liquid ejecting portion", and the liquid storage chamber Rk2 of the liquid ejecting portion Uk2 is an example of the "fourth liquid storage chamber".

The communication flow path Pk1_m1 that enables the common flow path Qk1 of the distribution flow path Vk1 and the liquid storage chamber Rk1 of the ejecting head portion Hm1 to communicate with each other is an example of the "first communication flow path", and the communication flow path Pk1_m2 that enables the common flow path Qk1 and the liquid storage chamber Rk1 of the ejecting head portion Hm2 to communicate with each other is an example of the "second communication flow path". Similarly, the communication flow path Pk2_m1 that enables the common flow path Qk2 and the liquid storage chamber Rk2 of the ejecting head portion Hm1 to communicate with each other in the distribution flow path Vk2 is an example of the "third communication flow path", and the communication flow path Pk2_m2 that enables the common flow path Qk2 and the liquid storage chamber Rk2 of the ejecting head portion Hm2 to communicate with each other is an example of the "fourth communication flow path".

2. Embodiment 2

Embodiment 2 will be described. In each aspect illustrated below, elements having the same functions as those in Embodiment 1 will be appropriately omitted by using the reference numerals used in the description of Embodiment 1.

Figure 12:
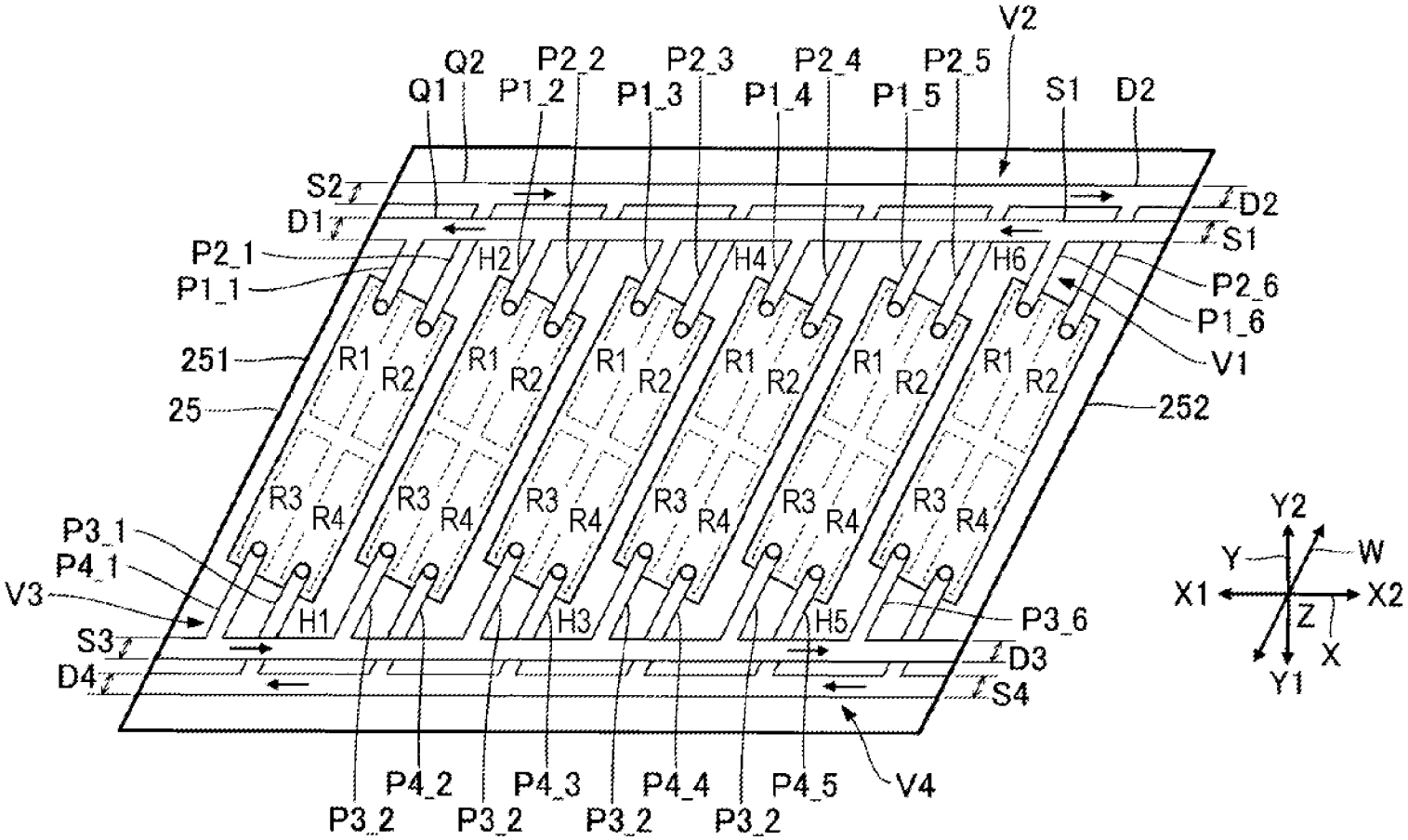
FIG. 12 is a plan view schematically illustrating the configuration of an internal flow path of a liquid distributing portion in Embodiment 2.
Figure 13:
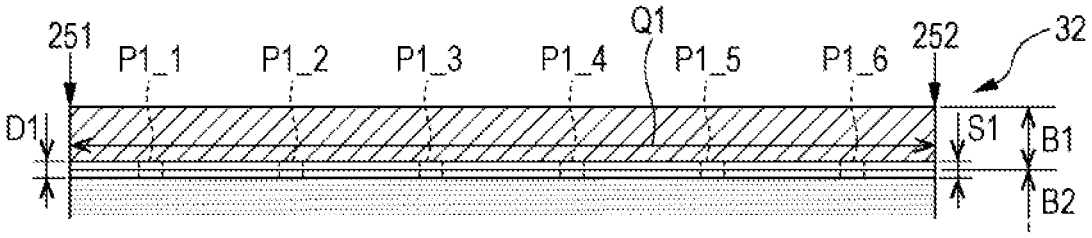
FIG. 13 is a sectional view taken along a common flow path in Embodiment 2.

FIG. 12 is a plan view schematically illustrating the configuration of the internal flow path of the liquid distributing portion 32 in Embodiment 2, and FIG. 13 is a sectional view taken along the common flow path Q1. As illustrated in FIG. 13, the supply flow path S1 and the collection flow path D1 of the distribution flow path V1 in Embodiment 2 are formed between the first substrate B1 and the second substrate B2 together with the common flow path Q1. As illustrated in FIG. 12, the supply flow path S1 opens on a side surface 252 of the flow path structure 30. The collection flow path D1 opens on a side surface 251 of the flow path structure 30.

Although the above description focuses on the distribution flow path V1, the same applies to the other distribution flow paths V2 to V4. For example, the supply flow path S2 and the collection flow path D2 of the distribution flow path V2 are formed between the second substrate B2 and the third substrate B3 together with the common flow path Q2. As illustrated in FIG. 12, the supply flow path S2 opens on the side surface 251 of the flow path structure 30, and the collection flow path D2 opens on the side surface 252 of the flow path structure 30.

The supply flow path S3 and the collection flow path D3 of the distribution flow path V3 are formed between the first substrate B1 and the second substrate B2, and the supply flow path S4 and the collection flow path D4 of the distribution flow path V4 are formed between the second substrate B2 and the third substrate B3. As illustrated in FIG. 12, the supply flow path S3 and the collection flow path D4 open to the side surface 251, and the collection flow path D3 and the supply flow path S4 open to the side surface 252.

In Embodiment 2, the same effect as in Embodiment 1 is realized. In Embodiment 2, since the supply flow path Sk and the collection flow path Dk are formed at the side surface of the flow path structure 30, there is an advantage that the size of the flow path structure 30 in the Z-axis direction is reduced. On the other hand, in Embodiment 1, since the supply flow path Sk and the collection flow path Dk are configured by through holes along the Z-axis, there is an advantage that the size of the flow path structure 30 in the XY plane can be reduced as compared with Embodiment 2.

3. Embodiment 3

Figure 14:
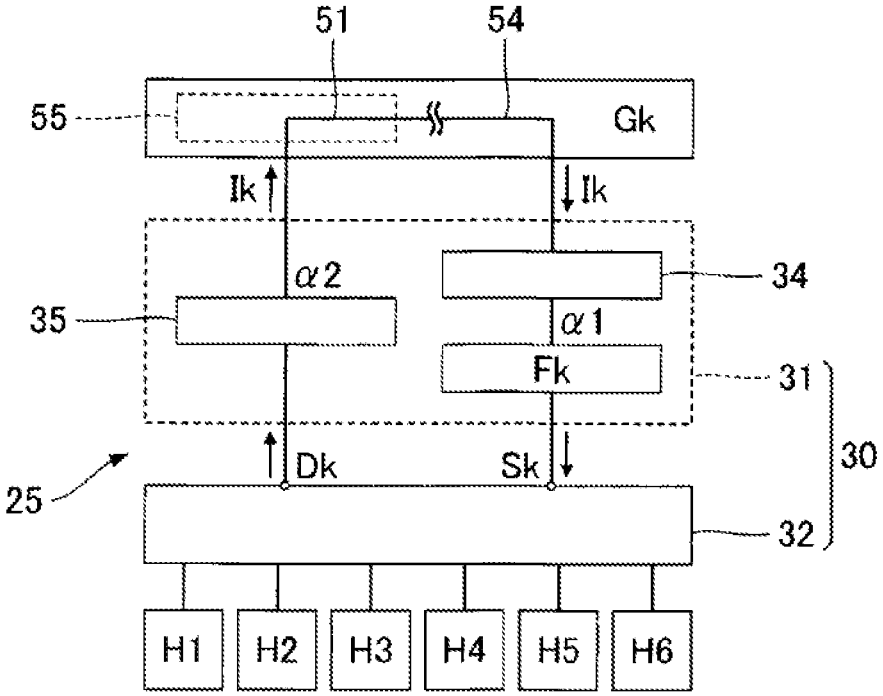
FIG. 14 is a block diagram illustrating a configuration of a liquid ejecting head according to Embodiment 3.

FIG. 14 is a block diagram illustrating the configuration of the liquid ejecting head 25 according to Embodiment 3. Only the elements associated with any one type of ink Ik are illustrated for convenience in FIG. 14.

As illustrated in FIG. 14, the liquid processing portion 31 in the liquid ejecting head 25 of Embodiment 3 includes a first regulating valve 34 and a second regulating valve 35 in addition to the same filter Fk and circulation mechanism Gk as in Embodiment 1. The first regulating valve 34 is installed between the circulation mechanism Gk and the supply flow path Sk of the liquid distributing portion 32. For example, the first regulating valve 34 is installed between the second circulation flow path 54 of the circulation mechanism Gk and the filter Fk. The ink Ik that passes through the first regulating valve 34 is supplied to the supply flow path Sk. Further, the first regulating valve 34 may be installed between the filter Fk and the supply flow path Sk.

The first regulating valve 34 is a valve mechanism that opens and closes in accordance with the pressure α1 of the ink Ik downstream of the first regulating valve 34. The pressure α1 is the pressure of the ink Ik between the first regulating valve 34 and the filter Fk. Specifically, the first regulating valve 34 is kept in a closed state normally, and transitions to an open state when the pressure α1 reaches a predetermined negative pressure. The open state is a state in which the ink Ik is allowed to pass. The closed state is a state in which the ink Ik is blocked by closing the flow path of the ink Ik. When the first regulating valve 34 transitions to the open state, the pressure α1 rises as the ink Ik passes through the first regulating valve 34. As understood from the above description, the first regulating valve 34 functions as a negative pressure generating portion that maintains the pressure α1 at a predetermined negative pressure.

The second regulating valve 35 is installed between the collection flow path Dk and the circulation mechanism Gk of the liquid distributing portion 32. For example, the second regulating valve 35 is installed between the collection flow path Dk and the first circulation flow path 51 of the circulation mechanism Gk. That is, the ink Ik collected through the collection flow path Dk is supplied to the second regulating valve 35.

The second regulating valve 35 is a valve mechanism that opens and closes in accordance with the pressure α2 of the ink Ik downstream of the second regulating valve 35. The pressure α2 is the pressure of the ink Ik between the second regulating valve 35 and the circulation mechanism Gk. Specifically, the pressure α2 is the pressure of the ink Ik in the first circulation flow path 51 of the circulation mechanism Gk. Similar to the first regulating valve 34, the second regulating valve 35 maintains a closed state normally, and transitions to an open state when the pressure α2 reaches a predetermined negative pressure.

The circulation mechanism Gk of Embodiment 3 includes a pressure adjustment portion 55 that adjusts the pressure α2 of the ink Ik in the first circulation flow path 51. The pressure adjustment portion 55 can reduce the pressure α2 in accordance with, for example, an instruction from the control unit 21.

In the above configuration, when the pressure adjustment portion 55 reduces the pressure α2, the second regulating valve 35 transitions to the open state. When the ink Ik passes through the second regulating valve 35 in the open state, the pressure α1 downstream of the first regulating valve 34 decreases. As described above, when both the first regulating valve 34 and the second regulating valve 35 transition to the open state, the ink Ik in the common flow path Qk of the liquid distributing portion 32 circulates through a route that is the common flow path Qk→the collection flow path Dk→the second regulating valve 35→the circulation mechanism Gk→the first regulating valve 34→the filter Fk→the supply flow path Sk→the common flow path Qk.

The specific configuration of the liquid distributing portion 32 in Embodiment 3 is the same as that in Embodiment 1. Therefore, Embodiment 3 can achieve the same effect as Embodiment 1. In addition, in Embodiment 3, the simple operation of adjusting the pressure α2 downstream of the second regulating valve 35 has an advantage that a circulation operation for circulating the ink Ik collected from the liquid ejecting head 25 to the liquid ejecting head 25 is realized. Further, the configuration of Embodiment 3 is applied to both Embodiment 1 and Embodiment 2.

4. Embodiment 4

Figure 15:
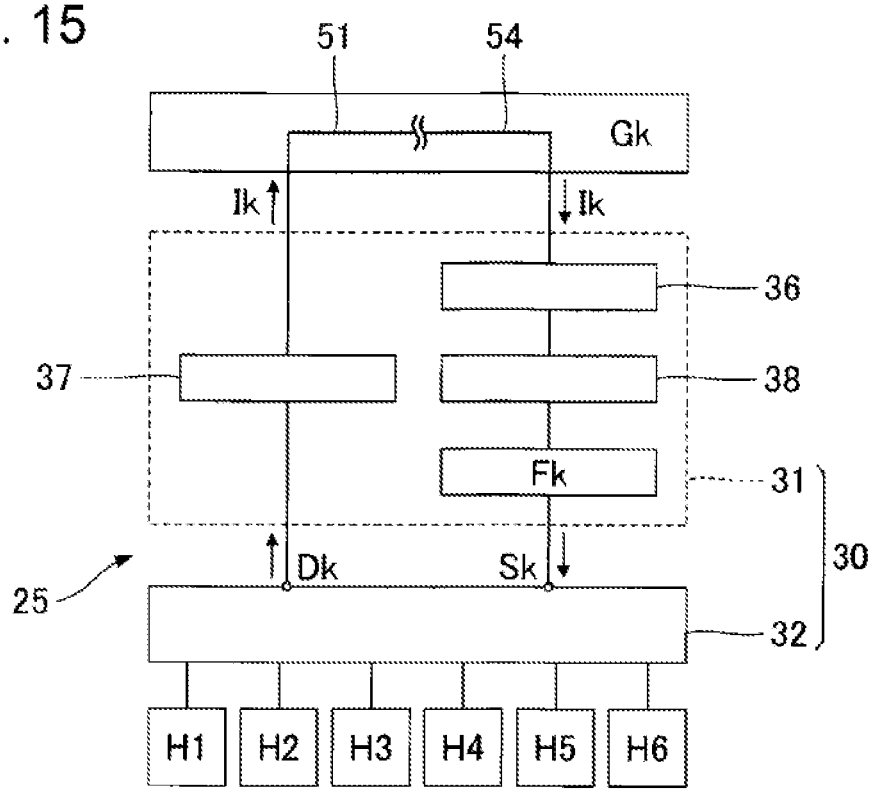
FIG. 15 is a block diagram illustrating a configuration of a liquid ejecting head according to Embodiment 4.

FIG. 15 is a block diagram illustrating the configuration of the liquid ejecting head 25 according to Embodiment 4. Only the elements associated with any one type of ink Ik are illustrated for convenience in FIG. 15.

As illustrated in FIG. 15, the liquid processing portion 31 in the liquid ejecting head 25 of Embodiment 4 includes a first opening/closing valve 36, a second opening/closing valve 37, and a pressurizing mechanism 38 in addition to the filter Fk and the circulation mechanism Gk similar to those in Embodiment 1. The first opening/closing valve 36, the second opening/closing valve 37, and the pressurizing mechanism 38 are used for a maintenance operation of the liquid ejecting head 25. The maintenance operation of Embodiment 4 is an operation for forcibly discharging the ink Ik from the plurality of nozzles N of the liquid ejecting head 25. By forcibly discharging the ink Ik from the plurality of nozzles N, thickening or settling of the ink Ik in each of the ejecting head portions is reduced. In addition, it is also possible to discharge bubbles or foreign matter mixed in the ink Ik in each of the ejecting head portions from the nozzles N together with the ink Ik by the maintenance operation.

The first opening/closing valve 36 is installed between the circulation mechanism Gk and the supply flow path Sk of the liquid distributing portion 32. Specifically, the first opening/closing valve 36 is installed between the second circulation flow path 54 of the circulation mechanism Gk and the filter Fk. The pressurizing mechanism 38 is installed between the first opening/closing valve 36 and the supply flow path Sk. Specifically, the pressurizing mechanism 38 is installed between the first opening/closing valve 36 and the filter Fk. That is, the pressurizing mechanism 38 is installed downstream of the first opening/closing valve 36.

The first opening/closing valve 36 is controlled to be in an open state or a closed state in accordance with an instruction from the control unit 21. The open state is a state in which the ink Ik supplied to the supply flow path Sk is allowed to pass. The closed state is a state in which the ink Ik is blocked. The pressurizing mechanism 38 pressurizes the ink Ik between the first opening/closing valve 36 and the supply flow path Sk in accordance with an instruction from the control unit 21. Further, the specific configuration of the pressurizing mechanism 38 for pressurizing the ink Ik is arbitrary. For example, the pressurizing mechanism 38 may pressurize the ink Ik by reducing the volume of the supply flow path Sk. For example, the pressurizing mechanism 38 may pressurize the ink Ik by deforming a flexible film constituting a portion of the wall surface of the supply flow path Sk. In addition, the pressurizing mechanism 38 may pressurize the ink Ik by supplying the ink Ik to the supply flow path Sk. For example, the pressurizing mechanism 38 includes a port to which a tube communicating with the liquid container 12 is coupled, and supplies the ink Ik from the liquid container 12 to the supply flow path Sk via the port.

The second opening/closing valve 37 is installed between the collection flow path Dk of the liquid distributing portion 32 and the circulation mechanism Gk. For example, the second opening/closing valve 37 is installed between the collection flow path Dk and the first circulation flow path 51 of the circulation mechanism Gk. That is, the ink Ik collected through the collection flow path Dk is supplied to the second opening/closing valve 37. The second opening/closing valve 37 is controlled to be in an open state or a closed state in accordance with an instruction from the control unit 21. The open state is a state in which the ink Ik collected through the collection flow path Dk is allowed to pass. The closed state is a state in which the ink Ik is blocked.

The control unit 21 maintains both the first opening/closing valve 36 and the second opening/closing valve 37 in the open state during the period in which the normal ejecting operation is executed by the liquid ejecting unit 23. On the other hand, during the period when the ejecting operation is not executed, the maintenance operation using the first opening/closing valve 36, the second opening/closing valve 37, and the pressurizing mechanism 38 is executed. Specifically, the control unit 21 controls both the first opening/closing valve 36 and the second opening/closing valve 37 to be in a closed state. In addition, the control unit 21 causes the pressurizing mechanism 38 to pressurize the ink Ik while both the first opening/closing valve 36 and the second opening/closing valve 37 are maintained in the closed state.

When the ink Ik is pressurized while the first opening/closing valve 36 and the second opening/closing valve 37 are kept closed, the ink Ik in the liquid storage chambers Rk of each of the ejecting head portions Hm is pressurized. Accordingly, the ink Ik in the liquid storage chamber Rk is forcibly discharged from the plurality of nozzles N in the nozzle row Lk. For example, the ink Ik adhering to the ejection surface due to leakage from the plurality of nozzles N is wiped off by, for example, a wiper that contacts the ejection surface. In addition, the ink Ik may be ejected from the plurality of nozzles N by pressurizing the ink Ik by the pressurizing mechanism 38.

The specific configuration of the liquid distributing portion 32 in Embodiment 4 is the same as that in Embodiment 1. Therefore, the same effect as that of Embodiment 1 is realized in Embodiment 4. In addition, in Embodiment 4, by operating the pressurizing mechanism 38 in a state where both the first opening/closing valve 36 and the second opening/closing valve 37 are kept closed, it is possible to pressurize the ink Ik inside each of the liquid ejecting portions Uk. Further, the configuration of Embodiment 4 is applied to both Embodiment 1 and Embodiment 2.

5. Embodiment 5

Figure 16:
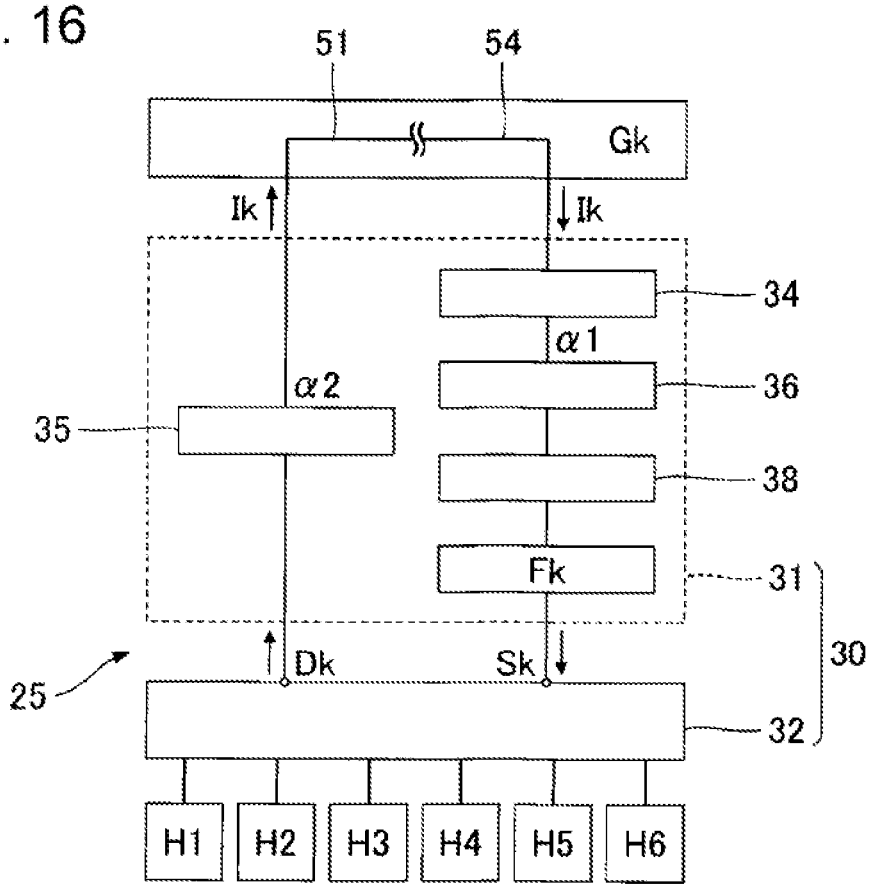
FIG. 16 is a block diagram illustrating a configuration of a liquid ejecting head according to a modification.

FIG. 16 is a block diagram illustrating the configuration of the liquid ejecting head 25 according to Embodiment 5. Only the elements associated with any one type of ink Ik are illustrated for convenience in FIG. 16. The liquid ejecting head 25 according to Embodiment 5 has a configuration in which Embodiment 3 and Embodiment 4 are combined.

As illustrated in FIG. 16, in addition to the filter Fk similar to that of Embodiment 1, the first regulating valve 34, the first on-off valve 36, and the pressurizing mechanism 38 are installed between the second circulation flow path 54 of the circulation mechanism Gk and the supply flow path Sk of the liquid distributing portion 32. Specifically, the first opening/closing valve 36 is installed between the first regulating valve 34 and the supply flow path Sk, and the pressurizing mechanism 38 is installed between the first open-close valve 36 and the supply flow path Sk. That is, the first opening/closing valve 36 and the pressurizing mechanism 38 are installed downstream of the first regulating valve 34. Further, in FIG. 16, the filter Fk is installed downstream of the pressurizing mechanism 38; however, the position where the filter Fk is installed is arbitrary.

The first regulating valve 34 opens and closes in accordance with the pressure $\alpha 1$ of the ink Ik downstream of the first regulating valve 34, as in Embodiment 3. The pressure $\alpha 1$ is the pressure of the ink Ik between the first regulating valve 34 and the first opening/closing valve 36. The first opening/closing valve 36 is controlled to be in an open state or a closed state in accordance with an instruction from the control unit 21 as in Embodiment 4. The first opening/closing valve 36 is maintained in the open state during the period in which the ejecting operation or the circulation operation is executed. The pressurizing mechanism 38 pressurizes the ink Ik between the first opening/closing valve 36 and the supply flow path Sk in accordance with an instruction from the control unit 21 as in Embodiment 4.

The second regulating valve 35 is installed between the collection flow path Dk of the liquid distributing portion 32 and the first circulation flow path 51 of the circulation mechanism Gk. The second regulating valve 35 is a valve mechanism that opens and closes in accordance with the pressure $\alpha 2$ of the ink Ik downstream of the second regulating valve 35.

When performing the circulation operation, the control unit 21 controls the second regulating valve 35 to be in the open state by reducing the pressure $\alpha 2$ by the pressure adjustment portion 55. Since the first opening/closing valve 36 is maintained in the open state, the pressure $\alpha 1$ decreases in conjunction with the pressure $\alpha 2$. When the pressure $\alpha 1$ reaches a predetermined negative pressure, the first regulating valve 34 transitions to the open state. Therefore, similarly to Embodiment 3, a circulation operation for circulating the ink Ik collected through the collection flow path Dk to the supply flow path Sk is executed.

On the other hand, when performing the maintenance operation, the control unit 21 controls the first opening/closing valve 36 to be closed. The second regulating valve 35 is maintained in a closed state. As described above, the control unit 21 causes the pressurizing mechanism 38 to pressurize the ink Ik while both the first opening/closing valve 36 and the second regulating valve 35 are maintained in the closed state. The ink Ik in the liquid storage chambers Rk of each of the ejecting head portions Hm is pressurized by the above operation, whereby the ink Ik in the liquid storage chambers Rk is discharged from the plurality of nozzles N of the nozzle row Lk. That is, as in Embodiment 4, a maintenance operation for forcibly discharging the ink Ik in the liquid storage chamber Rk from the plurality of nozzles N is executed. As understood from the above description, the second regulating valve 35 of Embodiment 5 realizes the same function as the second opening/closing valve 37 of Embodiment 4. Therefore, there is an advantage that the configuration of the flow path structure 30 is simplified as compared with the configuration in which the second regulating valve 35 and the second opening/closing valve 37 are installed in the liquid processing portion 31. Further, the second regulating valve 35 of FIG. 16 may be replaced with the second opening/closing valve 37 of Embodiment 4.

6. Modifications

The embodiments illustrated above can be variously modified. Specific modifications that can be applied to the above-described embodiments will be exemplified below. Two or more embodiments arbitrarily selected from the following examples can be appropriately combined as long as they do not contradict each other.

(1) In each of the above-described embodiments, although the configuration in which each ejecting head portion Hm and the flow path structure 30 are directly coupled is illustrated, other elements may be interposed between each of the ejecting head portions Hm and the flow path structure 30. For example, the liquid processing portion 31 according to each embodiment described above may be installed between the flow path structure 30 and each of the ejecting head portions Hm. That is, in addition to the configuration in which the common flow paths Qk of the flow path structure 30 directly communicate with the liquid storage chambers Rk of the ejecting head portions Hm, a configuration in which the common flow paths Qk and the liquid storage chambers Rk communicate with each other indirectly through other elements such as various valve mechanisms or filters is also included in the scope of the present disclosure.

(2) In each of the above-described embodiments, the flow path structure 30 formed by stacking the first substrate B1, the second substrate B2, and the third substrate B3 has been exemplified; however, other elements may be interposed between the first substrate B1 and the second substrate B2 or the second substrate B2 and the third substrate B3. In addition, the number or shape of the substrates B constituting the flow path structure 30 is any number or shape.

(3) In each of the above-described embodiments, although the flow paths are formed by combining groove portions formed at each of the two substrates B facing each other, the flow paths may be formed by groove portions formed at one of the substrates. For example, the common flow path S1 and the common flow path S3 are formed by closing a groove formed in one of the first substrate B1 and the second substrate B2 with the other substrate B. Similarly, the common flow path S2 and the common flow path S4 are formed by closing a groove formed in one of the second substrate B2 and the third substrate B3 with the other substrate B.

(4) In each of the above-described embodiments, Although different types of ink Ik are supplied to each of the four liquid ejecting portions U1 to U4 of the head portions Hm, one type of ink may be supplied to the four liquid ejecting portions U1 to U4. That is, the same type of liquid may be supplied to a plurality of liquid ejecting portions Uk included in one ejecting head portion Hm. In addition, a plurality of communication flow paths Pk_m may be coupled to one ejecting head portion Hm.

(5) In each of the above-described embodiments, the liquid processing portion 31 is installed in the liquid ejecting head 25; however, the liquid processing portion 31 may be installed separately from the liquid ejecting head 25. That is, the liquid processing portion 31 is installed in the liquid ejecting unit 23 or the liquid ejecting apparatus 100. In addition, in each of the above-described embodiments, the circulation mechanism Gk is installed in the liquid processing portion 31; however, the circulation mechanism Gk may be installed separately from the liquid processing portion 31. That is, the circulation mechanism Gk is installed in the liquid ejecting unit 23 or the liquid ejecting apparatus 100.

(6) In each of the above-described embodiments, although the ink Ik in the pressure chamber C is ejected from the nozzle N, the ink Ik that is not ejected from the nozzle N out of the ink Ik in the pressure chamber C may be collected in the collection flow path Dk or the liquid container 12. In addition, the ink Ik that is not supplied to the pressure chamber C out of the ink Ik in the liquid storage chamber Rk may be collected in the collection flow path Dk or the liquid container 12.

(7) In each of the above-described embodiments, although the line head in which the plurality of nozzles N are distributed over the entire range of the medium 11 in the X-axis direction is exemplified as the liquid ejecting unit 23, the present disclosure can also be applied to a serial-type liquid ejecting apparatus that reciprocates a transport body, on which one or more of the liquid ejecting heads 25 are mounted, along the X axis.

(8) The liquid ejecting apparatus 100 exemplified in the above-described embodiment can be employed in various apparatuses such as a facsimile apparatus and a copying machine in addition to an apparatus dedicated to printing. However, the use of the liquid ejecting apparatus is not limited to printing. For example, a liquid ejecting apparatus that ejects a solution of a coloring material is used as a manufacturing apparatus that forms a color filter of a display device such as a liquid crystal display panel. In addition, a liquid ejecting apparatus that ejects a solution of conductive materials can be used as a manufacturing device for forming wiring or electrodes of a wiring substrate or the like. In addition, a liquid ejecting apparatus that ejects an organic solution related to a living body is, for example, used as a manufacturing apparatus that manufactures a biochip.

What is claimed is:

1. A liquid ejecting head comprising:

a first liquid ejecting portion including a first liquid storage chamber storing a liquid and a first nozzle configured to eject the liquid in the first liquid storage chamber;

a second liquid ejecting portion including a second liquid storage chamber storing the liquid and a second nozzle configured to eject the liquid in the second liquid storage chamber; and a flow path structure being formed by stacking substrates and including a distribution flow path that supplies the liquid to the first liquid storage chamber and the second liquid storage chamber, wherein the distribution flow path includes a common flow path through which the liquid flows, a supply flow path that supplies the liquid to the common flow path, a collection flow path that collects the liquid from the common flow path, a first communication flow path communicating the common flow path with the first liquid storage chamber, and a second communication flow path communicating the common flow path with the second liquid storage chamber.

2. The liquid ejecting head according to claim 1, wherein the substrates include a first substrate in which the supply flow path and the collection flow path are formed, and a second substrate in which the first communication flow path and the second communication flow path are formed.

3. The liquid ejecting head according to claim 2, wherein the supply flow path and the collection flow path are through holes that penetrate the first substrate in a thickness direction.

4. The liquid ejecting head according to claim 1, wherein the first liquid storage chamber and the second liquid storage chamber are arranged in a first direction, and the common flow path extends in the first direction.

5. The liquid ejecting head according to claim 4, wherein the first liquid storage chamber and the second liquid storage chamber are long spaces in a second direction that intersects the first direction.

6. The liquid ejecting head according to claim 1, further comprising a filter through which the liquid to be supplied to the supply flow path passes.

7. The liquid ejecting head according to claim 1, further comprising:

a first regulating valve that opens and closes in accordance with a pressure of the liquid downstream; and a second regulating valve that opens and closes in accordance with the pressure of the liquid downstream, wherein the liquid passing through the first regulating valve is supplied to the supply flow path, and the liquid collected through the collection flow path is supplied to the second regulating valve.

8. The liquid ejecting head according to claim 1, further comprising:

a first opening/closing valve configured to open for passing the liquid to be supplied to the supply flow path and to close for blocking flow of the liquid;

a pressurizing mechanism configured to pressurize the liquid between the first opening/closing valve and the supply flow path; and a second opening/closing valve configured to open for passing the liquid collected through the collection flow path and to close for blocking flow of the liquid.

9. A liquid ejecting apparatus comprising:

the liquid ejecting head according to claim 1; and a circulation mechanism configured to circulate the liquid collected through the collection flow path to the distribution flow path.

10. A liquid ejecting apparatus comprising:

a liquid ejecting head according to claim 1 configured to eject the liquid onto a medium; and a transport mechanism configured to transport the medium, wherein the common flow path extends in a direction intersecting a direction in which the medium is transported.

11. A liquid ejecting head comprising:

a first liquid ejecting portion including a first liquid storage chamber storing a liquid and a first nozzle configured to eject the liquid in the first liquid storage chamber;

a second liquid ejecting portion including a second liquid storage chamber storing the liquid and a second nozzle configured to eject the liquid in the second liquid storage chamber;

a third liquid ejecting portion including a third liquid storage chamber storing a liquid and a third nozzle configured to eject the liquid in the third liquid storage chamber;

a fourth liquid ejecting portion including a fourth liquid storage chamber storing the liquid and a fourth nozzle configured to eject the liquid in the fourth liquid storage chamber; and a flow path structure being formed by stacking substrates, and including a first distribution flow path that supplies the liquid to the first liquid storage chamber and the second liquid storage chamber, and a second distribution flow path that supplies the liquid to the third liquid storage chamber and the fourth liquid storage chamber, wherein the first distribution flow path includes a first common flow path through which the liquid flows, a first supply flow path that supplies the liquid to the first common flow path, a first collection flow path that collects the liquid from the first common flow path, a first communication flow path communicating the first common flow path with the first liquid storage chamber, and a second communication flow path communicating the first common flow path with the second liquid storage chamber, and the second distribution flow path includes a second common flow path through which the liquid flows, a second supply flow path that supplies the liquid to the second common flow path, a second collection flow path that collects the liquid from the second common flow path, a third communication flow path communicating the second common flow path with the third liquid storage chamber, and a fourth communication flow path communicating the second common flow path with the fourth liquid storage chamber.

12. A liquid ejecting apparatus comprising:

a liquid ejecting head according to claim 11 configured to eject the liquid onto a medium; and a transport mechanism configured to transport the medium, wherein the common flow path extends in a direction intersecting a direction in which the medium is transported.

* * * * *